US005482647A

United States Patent [19]

Bolkan et al.

[11] Patent Number: 5,482,647

[45] Date of Patent: Jan. 9, 1996

[54] HIGH SOLUBLE CARBONATE LAUNDRY DETERGENT COMPOSITION CONTAINING AN ACRYLIC TERPOLYMER

[75] Inventors: Steven A. Bolkan, Hopewell; Joseph G. Becker, Martinsville, both of N.J.

[73] Assignee: Church & Dwight Co., Inc., Princeton, N.J.

[21] Appl. No.: 129,426

[22] Filed: Sep. 30, 1993

[51] Int. Cl.[6] ..... C11D 3/14; C11D 3/20; C11D 3/37

[52] U.S. Cl. ..... 252/174.14

[58] Field of Search ..... 252/174.14

[56] References Cited

U.S. PATENT DOCUMENTS

| | | | |
|---|---|---|---|
| 4,265,790 | 5/1981 | Winston et al. | 252/532 |
| 4,464,292 | 8/1984 | Lengyel | 252/532 |
| 4,490,271 | 12/1984 | Spadini et al. | 252/174.23 |
| 4,521,332 | 6/1985 | Milora | 252/527 |
| 4,711,740 | 12/1987 | Carter et al. | 252/174.24 |
| 4,820,441 | 4/1989 | Evans et al. | 252/174.18 |
| 4,849,125 | 7/1989 | Seiter et al. | 252/109 |
| 5,279,756 | 1/1994 | Savio et al. | 252/174.14 X |
| 5,302,310 | 4/1994 | Houghton | 252/174.14 X |

*Primary Examiner*—Paul F. Shaver
*Attorney, Agent, or Firm*—Charles B. Barris

[57] ABSTRACT

A powdered laundry detergent composition is provided comprising an active surfactant, at least about 70 wt. % of a water soluble alkaline carbonate salt, and about 0.1 to 5.0 wt. % of a terpolymer of acrylic acid, maleic acid, and acrylamide.

Use of the foregoing detergent composition provides excellent cleaning and whitening of fabrics while avoiding any serious problem of eutrophication which occurs when a substantial amount of a phosphorus containing builder such as STPP is present in the composition, and while minimizing the problem of fabric encrustation often present when the composition contains a large amount of carbonate builder.

11 Claims, No Drawings

HIGH SOLUBLE CARBONATE LAUNDRY DETERGENT COMPOSITION CONTAINING AN ACRYLIC TERPOLYMER

BACKGROUND OF THE INVENTION

1. Field of the Invention

This invention relates to novel laundry detergent compositions having a high water-soluble alkaline carbonate builder content and low fabric encrustation properties.

2. Information Disclosure Statement Including Description of Related Art

The following information is being disclosed under the provisions of 37 CFR 1.56, 1.97 and 1.98.

It is conventional to use "builders" in detergent compositions which supplement and enhance the cleaning effect of an active surfactant present in the composition. Such builders improve the cleaning and whitening power of the detergent composition, for instance, by the sequestration or precipitation of hardness causing metal ions such as calcium and magnesium, solubilization of water-insoluble materials, peptization of soil agglomerates and neutralization of acid soil, as well as by enhancing various properties of the active detergent, such as its stabilization of solid soil suspensions, emulsification of soil particles, and foaming and sudsing characteristics. Other mechanisms by which builders improve the cleaning and whitening power of detergent compositions are probably present but are less well understood. Builders are important not only for their effect in improving the cleaning and whitening ability of active surfactants in detergent compositions, but also because they allow for a reduction in the amount of the surfactant used in the composition, the surfactant being generally much more costly than the builder.

Two important classes of builders have been widely used in recent years, viz., phosphorus containing salts such as sodium tripolyphosphate (STPP) which are very effective in sequestering calcium and magnesium ions without precipitating them, and soluble alkaline carbonates such as sodium carbonates which may be used in amounts up to 90 wt. % of the composition and which effectively precipitate the calcium and magnesium ions. However phosphorus-containing builders have been found to cause a serious problem of eutrophication of lakes, rivers and streams when present in detergent compositions in relatively large amounts, resulting in the passage of laws in several states mandating a drastic reduction in their use. While the use of soluble alkaline carbonate builders do not cause eutrophication, they result in the unrelated problem of fabric encrustation caused by the precipitation of calcium and magnesium carbonates which deposit on the fiber surfaces of fabrics, causing the fabric to have a stiff hand and giving colored fabrics a faded appearance.

Polymeric polycarboxylates such as polyacrylates are also known in the detergent art as effective sequestering and dispersing agents as well as crystal growth inhibitors. However, such polycarboxylates generally have limited antiencrustation effects when used in detergent compositions having a high soluble carbonate content.

The following prior art references may be considered relevant or material to the invention claimed herein.

U.S. Pat. Nos. 4,265,790, issued May 5, 1981 to Winston et al., and 4,464,292, issued Aug. 7, 1984 to Lengyel, disclose detergent compositions comprising an ethoxylated alcohol and an ethoxy sulfate as a combination of nonionic and anionic surfactants, and over 70 wt % of anhydrous sodium carbonate (soda ash) as a detergent builder.

U.S. Pat. No. 4,490,271, issued Dec. 25, 1984 to Spadini et al., discloses detergent compositions comprising an active surfactant, up to 80% of a non-phosphorus detergent builder such as a water soluble carbonate, and a polyacrylate such as a copolymer of acrylic acid with any of various comonomers including acrylamide.

U.S. Pat. No. 4,521,332, issued Jun. 4, 1985 to Milora, discloses highly alkaline liquid cleaning compositions comprising a nonionic surfactant, 10 to 45 wt. % of sodium hydroxide, 0.04 to 4 wt. % of a polyacrylic acid salt, 0 to 15 wt. % of an alkali metal phosphate builder such as STPP, 0.5 to 20 wt. % of a "building agent" such as sodium carbonate, and 6 to 60 wt. % of water.

U.S. Pat. No. 4,711,740, issued Dec. 8, 1987 to Carter et al., discloses detergent compositions comprising a "detergent active" compound, i.e., a surfactant, a detergent builder which is a water-soluble carbonate, e.g. sodium carbonate in an amount of "at least 5% by weight, such as from 10% to 40%, preferably 10% to 30% weight, though an amount up to 75% could possible be used if desired in special products", a water insoluble carbonate, e.g., calcium carbonate (calcite) in an amount of 5 to 60 wt. %, as seed crystals for precipitated calcium carbonate which is thus prevented from being deposited on fabrics; and a copolymer of a carboxylic monomer, e.g., acrylic acid, and a non-carboxylic monomer, e.g., acrylamide, such copolymer being present in an amount of 0.1 to 10 wt. % and acting as a colloid stabilizer for the precipitated calcium carbonate. Other detergency builders such as STPP may also be present.

U.S. Pat. No. 4,820,441, issued Apr. 11, 1989 to Evans et al., discloses granular detergent compositions which may contain in addition to an active surfactant, 5 to 75 wt. % of a crystal growth modified, carbonate-based structurant salt, 0.1 to 20 wt. % of a polymeric polycarboxylate, e.g., an acrylic acid/maleic acid copolymer, as crystal growth modifier based on the weight of the structurant salt, and 0 to 40 wt. % of STPP. The structurant salt may contain sodium sulfate as well as sodium carbonate and sodium bicarbonate, and the two tables under the heading "PRODUCTS OF THE INVENTION" in columns 8 and 9 of the patent show a maximum of 40 wt. % of sodium carbonate in the final product composition.

U.S. Pat. No. 4,849,125, issued Jul. 18, 1989 to Seiter et al., discloses phosphate-reduced, granular, freeflowing detergent compositions comprising 4 to 40 wt. % of a nonionic surfactant, 3 to 20 wt. % of an anionic surfactant, 0.5 to 15 wt. % of a homopolymeric or copolymeric carboxylic acid or salt such as a copolymer of acrylic acid and acrylamide, 0 to 20 wt. % of STPP, and, optionally, up to 15 or 20 wt. % of sodium carbonate.

SUMMARY OF THE INVENTION

In accordance with this invention a powdered laundry detergent composition is provided comprising an active surfactant, at least about 70 wt. % of a water soluble alkaline carbonate salt, and about 0.1 to 5.0 wt. % of a terpolymer of acrylic acid, maleic acid and acrylamide (the "acrylic terpolymer").

Use of the foregoing detergent composition provides excellent cleaning and whitening of fabrics while avoiding the problem of eutrophication which occurs when a substantial amount, e.g., over about 50% of a phosphorus containing builder such as STPP is present in the composition, and while minimizing the problem of fabric encrustation often present when the composition contains a large amount of carbonate builder. In particular, it has been found that the detergent compositions of this invention containing the acrylic terpolymer cause a lower degree of fabric encrustation than when an equivalent amount of a conventional polyacrylate, viz., a salt of an acrylic acid homopolymer, is used in place of the acrylic terpolymer.

DETAILED DESCRIPTION OF THE INVENTION

The active surfactant component present in the laundry detergent composition of this invention may consist of one or more of many suitable synthetic detergent active compounds which are commercially available and described in the literature, for example, in "Surface Active Agents and Detergents," Volumes 1 and 2 by Schwartz, Perry and Berch. Several detergents and active surfactants are also described in, for example, U.S. Pat. Nos. 3,957,695; 3,865,754; 3,932,316 and 4,009,114. In general, the detergent composition may include a synthetic anionic, nonionic, amphoteric or zwitterionic detergent active compound, or mixtures of two or more of such compounds.

Preferably, the laundry detergent compositions of this invention contain at least one anionic or nonionic surfactant, and, more preferably, a mixture of the two types of surfactant, as described, for example, in U.S. Pat. Nos. 4,265,790 and 4,464,292, discussed previously.

The contemplated water soluble anionic detergent surfactants are the alkali metal (such as sodium and potassium) salts of the higher linear alkyl benzene sulfonates and the alkali metal salts of sulfated ethoxylated and unethoxylated fatty alcohols, and ethoxylated alkyl phenols. The particular salt will be suitable selected depending upon the particular formulation and the proportions therein.

The sodium alkybenzenesulfonate surfactant (LAS), if used in the composition of the present invention, preferably has a straight chain alkyl radical of average length of about 11 to 13 carbon atoms.

Specific sulfated surfactants which can be used in the compositions of the present invention include sulfated ethoxylated and unethoxylated fatty alcohols, preferably linear primary or secondary monohydric alcohols with $C_{10}$–$C_{18}$, preferably $C_{12}$–$C_{16}$, alkyl groups and, if ethoxylated, on average about 1–15, preferably 3–12 moles of ethylene oxide (EO) per mole of alcohol, and sulfated ethoxylated alkylphenols with $C_8$–$C_{16}$ alkyl groups, preferably $C_8$–$C_9$ alkyl groups, and on average from 4–12 moles of EO per mole of alkyl phenol.

The preferred class of anionic surfactants are the sulfated ethoxylated linear alcohols, such as the $C_{12}$–$C_{16}$ alcohols ethoxylated with an average of from about 1 to about 12 moles of ethylene oxide per mole of alcohol. A most preferred sulfated ethoxylated detergent is made by sulfating a $C_{12}$–$C_{15}$ alcohol ethoxylated with 3 moles of ethylene oxide per mole of alcohol.

Specific nonionic surfactants which can be used in the compositions of the present invention include ethoxylated fatty alcohols, preferably linear primary or secondary monohydric alcohols with $C_{10}$–$C_{18}$, preferably $C_{12}$–$C_{16}$, alkyl groups and on average about 1–15, preferably 3–12 moles of ethylene oxide (EO) per mole of alcohol, and ethoxylated alkylphenols with $C_8$–$C_{16}$ alkyl groups, preferably $C_8$–$C_9$ alkyl groups, and on average about 4–12 moles of EO per mole of alkyl phenol.

The preferred class of nonionic surfactants compounds are the ethoxylated linear alcohols, such as the $C_{12}$–$C_{16}$ alcohols ethoxylated with an average of from about 1 to about 12 moles of ethylene oxide per mole of alcohol. A most preferred nonionic detergent is a $C_{12}$–$C_{15}$ alcohol ethoxylated with 3 moles of ethylene oxide per mole of alcohol.

Mixtures of the foregoing synthetic detergent type of surfactants, e.g., of anionic and nonionic, or of different specific anionic or nonionic surfactants, may be used to modify the detergency, sudsing characteristics, and other properties of the composition. For example, a mixture of different fatty alcohols of 12 to 15 carbon atoms may be ethoxylated, directly sulfated, or sulfated after ethoxylation, a fatty alcohol may be partially ethoxylated and sulfated, or an ethoxylated fatty acid may be partially sulfated to yield a mixture of different anionic and nonionic surfactants or different specific anionic or nonionic surfactants.

The total active surfactant in the composition may be in the range, for example, of about 5 to 15 wt. % preferably about 8 to 10 wt. %. If, as preferred, the active surfactant consists of a combination of anionic and nonionic surfactants, then the anionic surfactant is present in the range, for example, of about 3 to 12 wt. % preferably about 5 to 10 wt. %, and the nonionic surfactant is present in the range, for example, of about 2 to 10 wt. %, preferably about 3 to 5 wt. %.

The water-soluble alkaline carbonate may be, for example, an alkali metal carbonate, bicarbonate or sesquicarbonate, preferably sodium or potassium carbonate, bicarbonate or sesquicarbonate, and most preferably sodium carbonate. A combination of more than one of such compounds may be used, e.g., sodium carbonate and sodium bicarbonate. The total water-soluble alkaline carbonate may be present in an amount, for example, of about 70 to 90 wt. % (intended as broadest practicable range), preferably about 75 to 85 wt. %. If a combination of alkali metal carbonate and bicarbonate is used as the water-soluble carbonate, then the alkali metal carbonate, e.g., sodium carbonate, is preferably used in an amount of about 75 to 80 wt. % and the alkali metal bicarbonate, e.g., sodium bicarbonate, in an amount of about 0.1 to 15 wt. %.

The acrylic terpolymer is a terpolymer, for example, of about 20 to 75 mol %, preferably about 50 to 60 mol % of acrylic acid, about 15 to 80 mol %, preferably about 40 to 50 mol %, of maleic acid, and about 0.001 to 20 mol %, preferably about 0.1 to 2 mol %, of acrylamide.

The acrylic terpolymer has a number average molecular weight, for example, of about 1,000 to 10,000, preferably about 2,000 to 5,000. To ensure substantial water solubility, the acrylic terpolymer is preferably completely or partially neutralized, e.g., with alkali metal ions, preferably sodium ions.

The acrylic terpolymer is present in the detergent composition in an amount of about 0.1 to 5.0 wt. %, preferably about 1.5 to 2.0 wt. %.

In the preparation of the solid composition of this invention, water is generally present, e.g., in an amount of about 1–12 wt. %, to assist granulation after which it can be removed. Any remaining water in the final composition is a combination of unremoved residual water and that absorbed from the air due to hygroscopicity.

Optionally the detergent of this invention may also contain a phosphorus-containing sequestering agent which may be, for example, an inorganic phosphate, e.g., a soluble orthophosphate metaphosphate, pyrophosphate or preferably a polyphosphate, such as an alkali metal phosphate of the type delineated, preferably a sodium or potassium tripolyphosphate. Organic phosphonates may also be employed as the phosphorus containing sequestering agent, particularly aminoethylenephosphonates (e.g., sold by Monsanto Company under the trademark "DEQUEST"), such as aminotri(methylenephosphonic acid) (ATMP), ethylenediaminetetra(methylenephosphonic acid) (EDTMP), hexamethylenediaminetetra(methylenephosphonic acid) (HMDTMP), and diethylenetriaminepenta(methylenephosphonic acid) (DETPMP). The most preferred phosphorus-containing sequestering agent is sodium tripolyphosphate (STPP).

The phosphorus-containing sequestering agent may be present in the detergent composition in an amount, for example, of about 0.1 to 2 wt. % preferably about 0.2 to 2 wt. %. These amounts generally do not cause a serious problem of eutrophication.

The laundry detergent compositions of this invention may also contain various adjuvants common to detergent formulations such as brighteners, enzymes, fabric softening agents, carboxymethylcellulose, fragrances, dyes and peroxide generating persalts.

The following examples further illustrate the invention.

Example 1 and Comparative Examples A and B

These examples illustrate the unexpectedly low amount of fabric encrustation obtained with the detergent composition of this invention.

In Example 1, the following components were compounded to formulate a laundry detergent composition under this invention. All quantities are given in parts by weight: 80 parts of sodium carbonate; 0.5 part of sodium bicarbonate; 6.0 parts of the sodium salt of a sulfonated $C_{12}$–$C_{15}$ alcohol ethoxylated with 3 moles of ethylene oxide per mole of alcohol (anionic surfactant); 3.2 parts of a $C_{12}$–$C_{15}$ alcohol ethoxylated with 3 moles of ethylene oxide per mole of alcohol (nonionic surfactant); 0.5 part of a terpolymer of about 55 mol % of acrylic acid, about 44 mol % of maleic acid, and about 1 mol % of acrylamide, having a number average molecular weight of about 3,500; and 8.8 parts of water.

In Comparative Example A the same components were compounded as shown for Example 1 except that 1.5 parts of sodium polyacrylate having a number average molecular weight of about 4500 was used in place of the terpolymer.

In Comparative Example B, the same components were compounded as shown for Example 1, except that no polymer at all was included and 10.3 rather than 8.8 parts of water were present.

The detergent compositions of Example 1 and Comparative Examples A and B were tested for fabric encrustation by repeated washing of cotton fabric at 95° F. with water hardness at 250 ppm (2/1 Ca/Mg ratio). In carrying out the test, four 25.4 cm.×25.4 cm., 100% black cotton fabric swatches along with 0.907 kg. of ballast are washed for 12 min. with 113.4 g of the detergent composition being tested such that the wash liquor contained about 0.162 wt. % of detergent. After washing is completed, 2.00–4.00 g of the calcium carbonate encrusted fabrics are extracted in 100 ml. of 0.2N hydrochloric acid for 30 min. and a 2.0–4.0 ml. aliquot is analyzed for hardness by the EDTA titration method. Encrustation is expressed as mg. calcium carbonate per gram of fabric.

Table I indicates the fabric encrustation as mg $CaCO_3$ per gram fabric after ten washing machine cycles of use.

TABLE I

| Example | Fabric Encrustation |
|---|---|
| 1 | 8.3 |
| A | 102.0 |
| B | 145.0 |

The results of Table I show a smaller degree of fabric encrustation when the acrylic terpolymer of this invention is present (Example 1) than is indicated by the fabric encrustation obtained when only a conventional polyacrylate (Comparative Example A) or no polymer at all (Comparative Example B) is present in the composition.

We claim:

1. A powdered laundry detergent composition comprising an active surfactant, at least about 70 wt. % of sodium carbonate, and about 0.1 to 5.0 wt. % of a terpolymer of about 20 to 75 mol % acrylic acid, about 15 to 80 mol % maleic acid, and about 0.001 to 20 mol % acrylamide (the acrylic terpolymer).

2. The composition of claim 1 comprising about 5 to 15 wt. % of said surfactant, about 75 to 85 wt. % of said alkaline carbonate salt, and about 1.5 to 2.0 wt. % of said acrylic terpolymer.

3. The composition of claim 1 wherein said acrylic terpolymer is a terpolymer of about 50 to 60 mol % of acrylic acid, about 40 to 50 mol % of maleic acid, and about 0.1 to 2 mol % of acrylamide.

4. The composition of claim 1 wherein the carboxyl groups of said acrylic terpolymer are at least partially neutralized.

5. The composition of claim 1 wherein said active surfactant comprises an anionic surfactant and a nonionic surfactant.

6. The composition of claim 5 wherein said anionic surfactant is an alkali metal salt of sulfated linear $C_{12}$–$C_{16}$ alcohols ethoxylated with an average of 1 to 12 moles of ethylene oxide per mole of alcohol and is present in an amount of about 3 to 12 wt. %, said nonionic surfactant consists of $C_{12}$–$C_{16}$ linear alcohols ethoxylated with an average of 1 to 12 moles of ethylene oxide per mole of alcohol and is present in an amount of about 2 to 10 wt. %, and the total active surfactant is present in an amount of about 5 to 15 wt. %.

7. The composition of claim 1 about 70 to 90 wt. % of sodium carbonate and about 0.1 to 15 wt. % of sodium bicarbonate, based on the weight of the composition.

8. The composition of claim 1 also containing about 0.1 to 2 wt. % of a phosphorus-containing sequestering agent.

9. The composition of claim 8 wherein said phosphorus-containing sequestering agent is sodium tripolyphosphate.

10. The composition of claim 8 wherein said phosphorus-containing sequestering agent is an aminomethylene phosphonate.

11. A process comprising washing a fabric in an aqueous wash liquor containing the composition of claim 1.

* * * * *

Adverse Decisions In Interference

Patent No. 5,482,647, Steven A. Bolkan, Joseph G. Becker, HIGH SOLUBLE CARBONATE LAUNDRY DETERGENT COMPOSITION CONTAINING AN ACRYLIC TERPOLYMER, Interference No. 103,944, final judgment adverse to the patentees rendered July 31, 1998, as to claims 1-11. *(Official Gazette October 27, 1998)*